United States Patent [19]

Wooding

[11] 4,433,421

[45] Feb. 21, 1984

[54] CONTROLLED ATMOSPHERE MELTING OF MOLTEN SLAG CHARGE

[75] Inventor: Patrick J. Wooding, Moorestown, N.J.

[73] Assignee: Wooding, Indian Mills, N.J.

[21] Appl. No.: 328,422

[22] Filed: Dec. 7, 1981

[51] Int. Cl.[3] ..... F27D 3/14

[52] U.S. Cl. ..... 373/79; 373/33

[58] Field of Search ..... 373/79, 80, 33, 34, 373/46, 43, 115, 142

[56] References Cited

U.S. PATENT DOCUMENTS 2,253,421 8/1941 de Mare ..... 373/142 X 3,905,804 6/1973 Scott, Jr. ..... 373/45 X

*Primary Examiner*—Roy N. Envall, Jr.

*Attorney, Agent, or Firm*—Duffield & Lehrer

[57] ABSTRACT

Molten slag is fed from a receptacle to an atmosphere-controlled carbon-lined electric furnace through a refractory-lined siphon tube without allowing atmospheric gases to enter the furnace. Siphoning is initiated by reducing the atmospheric pressure within the furnace through the use of an auxiliary vacuum tank. Slag from the furnace is spun to form mineral wool insulation.

5 Claims, 3 Drawing Figures

CONTROLLED ATMOSPHERE MELTING OF MOLTEN SLAG CHARGE

BACKGROUND OF THE INVENTION

Since the 1850's, mineral wool for thermal and acoustic insulation has been produced from a wide variety of raw materials, including furnace slags from copper, lead and iron production. To make mineral wool, these materials are remelted in fuel-fired cupola furnaces which are primitive devices offering little quality control, substantial air pollution and, in recent years, high operating cost because of the steep rise in the cost of coke, their principal fuel.

Careful and detailed studies of the reactions in large cupolas such as an iron blast furnace, decades of effort to establish optimum levels for all its parameters, and enormous increases in size (several recently commissioned units exceed 10,000 tons of iron per day, or 14,000 pounds per minute) have resulted in predictable quality and reasonable economy.

By contrast, the small cupola furnaces (5 tons per hour) in use all over the world to produce molten nonmetallics to be fiberized into mineral wool are small and inefficient. No economies of scale have been achieved, because mineral wool is bulky, and cannot be transported over great distances without absorbing the margin in freight costs. Further, the "spinners" used by most operators to fiberize the molten stream of slag discharging from the cupola are generally limited to 5 tons per hour per set, in present practice, and mounted one set per furnace, or "line."

As a result, the typical cupola currently in service to melt non-metallics for mineral wool is a water-cooled steel shell 6 to 7 feet in diameter and 15 to 25 feet high. It is by nature thermally inefficient, air polluting and high in operating cost. The quantities of particulate matter, sulphur and sulphur oxides in the top discharge of fume from the cupola require prohibitively high capital and maintenance costs to control, considering that only 5 tons per hour are melted.

The cupola's most important deficiency is its lack of control of the quality of the product. Residence time, in a molten state, of each increment of charge is very small, of the order of seconds in some cases or minutes at most. Modification of tapping temperature can only satisfactorily be achieved by charge additions, such as sand, to lower the melting point. Increase in melt rate can only be achieved by increasing the blast, with a consequent change in residence time and tapping temperature.

The ability of the spinning system to convert most of the cupola discharge into high quality product is a function of the surface tension of the molten stream, which in turn is affected by temperature, chemistry and viscosity. The inability of the cupola to control these variables results in poor average performance. Sometimes, when optimum fiberizing conditions are approached, a cupola/spinner combination converts a much higher percentage of its molten feed into high quality product, indicating that even modest control of the key melting variables will give significant improvement in yield.

Surface tension is a critical parameter in the fiberization process. The spinning wheel produces a plane sheet of liquid slag which is hit at right angles by a high velocity stream of air. The slag film is deflected and is subjected to aero-dynamic instabilities which develop into waves propagating with increased amplitude in more or less tangential orientation.

At the leading edge of the sheet, half or full wavelengths of the molten material are detached by the impact of the air blast and contract into ligaments under the influence of surface tension. What then happens to these ligaments, i.e. whether they are converted into useful fiber, or shot to be rejected, depends largely upon the temperature-viscosity relationship.

Since raw materials, particularly iron blast furnace slags, are in abundance as (mostly) waste matter, and mineral wool of good quality has high value as insulation, a number of attempts have been made over the last 20 years to find a more satisfactory melting method. These attempts have generally been based upon the use of an electric furnace for resistance, arc or induction melting of the charge, with a view to providing molten material which is controlled in terms of flow rate, temperature and composition, at a competitive cost.

Each of these attempts has failed, not because electric melting of slags is in itself particularly diffucult, but because its achievement in a controlled fashion with any conventional electric furnace has proved uneconomical.

The source energy used to melt a ton of blast furnace slag by means of a 5 ton per hour cupola may be shown to be about 7 million BTUs. Because of lack of control of the temperature, chemistry and rate of the cupola discharge, an average of 45 percent of this melted material is wasted as shot and tailings, so the source energy required for the melting of 1 ton of product is approximately 12.5 million BTUs. By contrast, under ideal conditions, the total heat required to raise 1 ton of iron blast furnace slag to tapping temperature is approximately 450 KWH, or 1.5 million BTUs. However, since the efficiency of a modern thermal power station is 37 percent at best, and transmission losses to the melting site will probably account for another 10 percent, the total source energy requirement to raise 1 ton of slag to tapping temperature is, under ideal conditions, 4.5 million BTUs. And therefore, in a conventional 5 ton per hour electric furnace of 70 percent overall thermal efficiency, source energy required is 6.4 million BTUs per ton melted. Assuming that the improvement in control of tapping temperature, chemistry and rate due to conventional electric melting provides an increase in useful mineral wool product from the present 55 percent to 65 percent, the net source energy requirement for this electric melter is 9.8 million BTUs per ton of product.

In summary, the source energy required per ton of mineral wool product is approximately 20 percent more for current cupola practice than it is for conventional electric melting.

Expressed in economic terms, at $170 per ton of coke, and an average cost in the United States of $0.028 per KWH (in 1979), the savings in energy cost indicated for conventional electric melting over cupola melting were approximately $10 per ton melted, or $18 per ton of product.

Unfortunately, these savings in energy cost are offset by the high cost of refractories in the conventional electric furnace, because molten slag and the presence of available oxygen will erode all known refractory lining systems, even carbon and graphite. Carbonaceous materials oxidized, or burn away increasingly rapidly as their temperatures rise above 500 degrees C. For example, industrial graphite loses 6 percent of its weight by oxidation when maintained at 600 degrees C. in air for only two and a half hours. The melting point of iron blast furnace slag, depending upon composition, is 1,370 to 1,540 degrees C.

Co-pending application Ser. No. 119,450 filed Feb. 7, 1980 now U.S. Pat. No. 4,389,724 (International Application No. PCT/US81/00129 published Aug. 20, 1981 as No. WO 81/02339) discloses an invention which substantially overcomes the above-described problems with the prior art systems. As disclosed therein, this is accomplished by constructing an electric melting furnace equipped for high integrity atmosphere control, thereby excluding atmospheric oxygen and permitting the use of carbonaceous materials as an economical refractory lining.

This fully enclosed furnace lends itself to thermal insulation of a very high order, permitting thermal efficiencies of 80 to 85 percent for a 5 ton furnace, with corresponding reductions in source energy requirements and operating cost.

The quantity of fume generated by a totally enclosed furnace, from which atmospheric air is excluded, is a small fraction of that resulting from the thousands of cubic feet of counterflow air blast needed for cupola operation. Consequently, fume handling for the new furnace is reduced to modest, relatively inexpensive proportions.

Charge increments are delivered through an atmosphere lock into a molten pool constituting approximately 1 hour of production. The resulting 30 to 60 minute residence time, in conjunction with fully variable energy input and charge and discharge rates, and controlled atmosphere, make the furnace inherently capable of very close control of tap temperature, chemistry and rate, permitting predictable surface tension and viscosity, and corresponding improvements in product quality and yield.

The furnace disclosed in the co-pending application also accepts and recycles the rejected shot and tailings which cannot be utilized by the cupola, thereby permitting significant savings in raw material and waste handling costs.

The cumulative effect of the foregoing advantages are substantial savings in source energy and operating cost. With reasonable refractory life, a furnace efficiency of 85 percent, a spinner yield of 75 percent and full recycling of shot and tailings, the source energy required per ton of product drops from 12.5 million BTUs in the cupola to 7 million BTUs, and operating cost drops by more than $40 per ton of product, using 1979 figures.

DISCLOSURE OF INVENTION

The present invention goes substantially further in the directions of energy saving and cost economy than does the above-identified co-pending application by adapting the furnace disclosed therein to charge material which is molten.

In the basic steel-making process, hundreds of millions of tons of molten iron are produced yearly, worldwide, by melting ore in iron blast furnaces. The by-product, sometimes equal in quantity to the iron produced, is molten slag. This mixture of lime, silica, alumina and magnesia is accurately described as dross, since most of it is thrown away to form the ugly slag piles of the world's basic steel-making sites. It is expensive to create and own one of these slag piles so the present method of disposal of slag adds significantly to the cost of each ton of steel produced.

More or less successful attempts have been made in various parts of the world to make use of this slag, in solidified, crushed and screened form, for such applications as light-weight aggregate, raw material for cement production, solid charge to cupolas for mineral wool production, etc.

A major, unused potential of molten slag from an iron blast furnace is its combination of thermal energy and proximity to mineral wool chemistry. This invention provides a simple and effective means of introducing molten slag into the atmosphere-controlled electric furnace of my co-pending application where its chemistry and temperature are adjusted before it is tapped directly onto a fiberizing spinner.

Typically, molten slag discharge from an iron blast furnace at 1450 degrees C. contains 450 KWH (or 1.5 million BTUs) of thermal energy and requires the addition of 10 to 15 percent of silica to make its chemistry suitable for spinning into high quality mineral wool. If the temperature loss of the slag during transfer is 100 degrees and the silica subsequently added is dry granulated material (sand) requiring 450 KWH per ton to melt, the total energy requirement per ton of product is given by:

| | |
|---|---|
| $(100/1450 + 15/115) \times 450$ | = 90 KWH/ton |
| Plus furnace losses (maximum of) | 40 KWH/ton |
| TOTAL ENERGY REQUIREMENTS | 130 KWH/ton melted |

The thermal energy in molten iron blast furnace slag may be regarded as "free" since it is in great abundance and has never before been harnessed. On this basis, the total "source" energy required for melting, at 65 percent manufacturing efficiency, is 200 KWH, or 2.0 million BTUs of fuel units at 33 percent generation and transmission efficiency.

This invention, therefore, reduces the source energy requirement for melting in mineral wool manufacture to about one-sixth of that required for current cupola practice. Compared with feeding the atmosphere-controlled electric melting furnace of my co-pending application with dry granulated slag, this invention reduces the melting energy required from 815 KWH per ton of product (at 85 percent thermal efficiency and 76 percent manufacturing efficiency) to 175 KWH per ton of product, i.e. to less than one-quarter of the lowest value previously attained.

Expressed in economic terms, the savings resulting from this invention are $25 per ton of product (at $0.05 per KWH in 1982) for energy alone, plus material handling savings of $5 to $10 per ton, compared with the most efficient melting method devised to date. Savings compared with current cupola practice are even greater, depending upon the local cost of coke.

My above-identified co-pending application describes an electric melting furnace equipped for high integrity atmosphere control, thereby excluding atmospheric oxygen and permitting the use of carbonaceous materials as an economical refractory lining. The present invention concerns the delivery to that furnace, without the coincident ingress of atmospheric air, of molten slag from any suitable receptacle.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

BEST MODE FOR CARRYING OUT THE INVENTION

Figure 1:
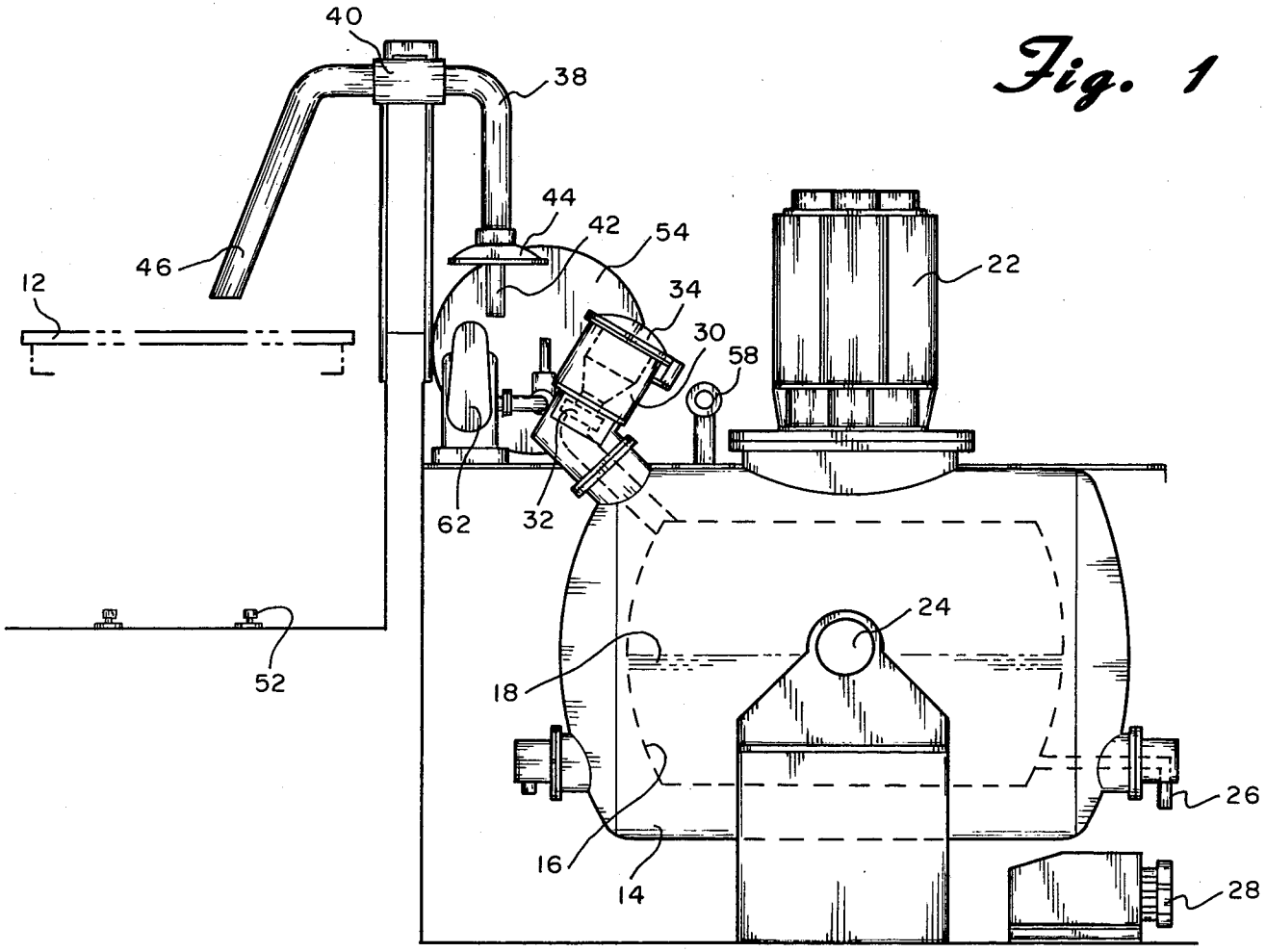
FIG. 1 is an elevational view and in partial schematic form of the major components of the system of the present invention.

Referring now to the drawings in detail wherein like reference numerals have been used throughout the various figures to designate like elements, there is shown in the figures a preferred arrangement for feeding molten slag 10 from receptacle 12 to the atmosphere-controlled electric melting furnace 14. Furnace 14 is shown only in schematic form since the furnace, per se, is described in substantial detail in co-pending application Ser. No. 119,450, the entire subject matter thereof being incorporated herein by reference. There are, of course, some changes made to the furnace 14 from that shown in the co-pending application which are necessary to adapt the same to the present invention. These changes will be described hereinbelow. The furnace is otherwise constructed and operated substantially in the manner described in the co-pending application.

Figure 3:
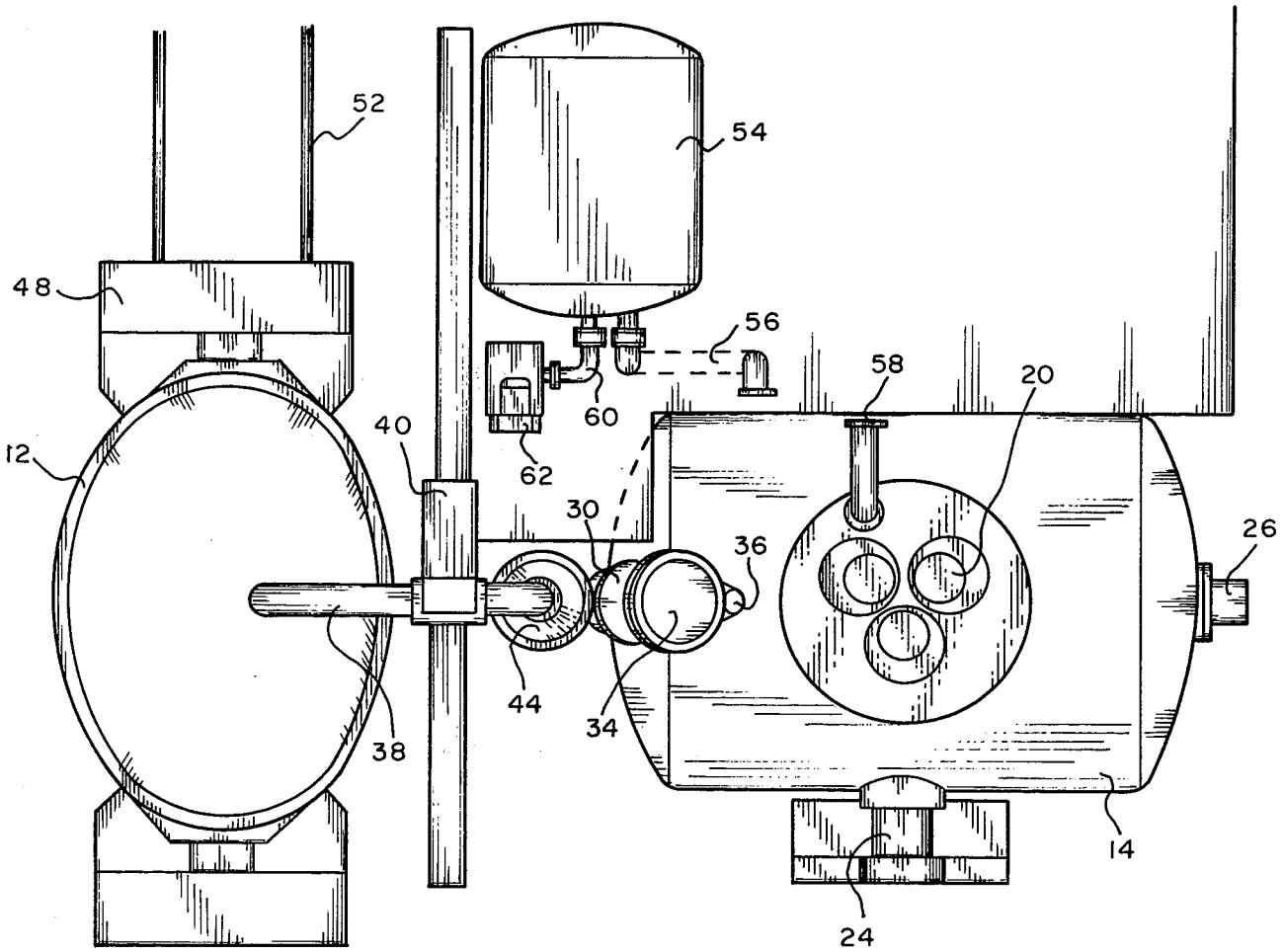
FIG. 3 is a top plan view of FIG. 1.

As explained more fully in applicant's co-pending application, furnace 14 includes a carbon lining 16 and heats slag 18 located within the furnace by the use of a plurality of electrodes 20 (FIG. 3) which are suspended into the interior of the furnace from suspension system 22. A port (not shown) is provided for controlling the atmosphere within the furnace by removing detrimental gases therefrom. This may be accomplished by evacuating the air from the interior of the furnace or by replacing the same with an inert gas which, for the present purposes, may be nitrogen. The furnace 14 is mounted so that it may be pivoted about tilting trunnions 24 and includes a taphole 26 which is located above spinner 28 which converts the molten slag from the furnace 14 into mineral wool fibers.

In the preferred embodiment of the furnace described in applicant's co-pending application, dry granular slag was intended to be used as the starting raw material and for that reason, an atmosphere-locked hopper system was provided for feeding the material to the furnace without the introduction of atmospheric air into the interior of the furnace. The presently described furnace may also be provided with such a hopper system which can be used for introducing additive materials such as silica or the like.

The present invention is specifically designed, however, to introduce molten slag as the starting material into the interior of the furnace 14. In order to accomplish this, the furnace is provided with an inlet feed port 30 which includes a shutoff valve 32 and a cover member 34 which is capable of closing and totally sealing the top of the port 30. The cover member 34 is hinged to the inlet feed port 30 by pivot means 36 so that the cover can be moved between its operative covering position shown in FIG. 1 and its inoperative position shown in FIG. 2.

Mounted adjacent the inlet feed port 30 is a substantially U-shaped refractory-lined feed tube 38. Feed tube 38 is carried by elevator means 40 so that the tube may be moved between its raised inoperative position shown in FIG. 1 and its lowered operative position shown in FIG. 2.

The first end 42 of the tube 38 carries a cover or sealing member 44 which is similar to the cover member 34. As shown most clearly in FIG. 2, when the furnace 14 is in its tilted position, the inlet port 30 directly underlies the end 42 of the tube 38 and when the tube 38 is moved downwardly by elevator 40, end 42 lies within the port 30 and cover member 44 seals the top of the port. In this position, the inlet end 46 of the tube 38 is located within the receptacle 12 which contains a quantity of molten slag 10. The receptacle 12 is preferably carried by a truck 48 having wheels 50 which ride on rails 52. In this way, the receptacle 12 with the feed slag 10 can be easily moved into position when the tube 38 is in its raised position.

Figure 2:
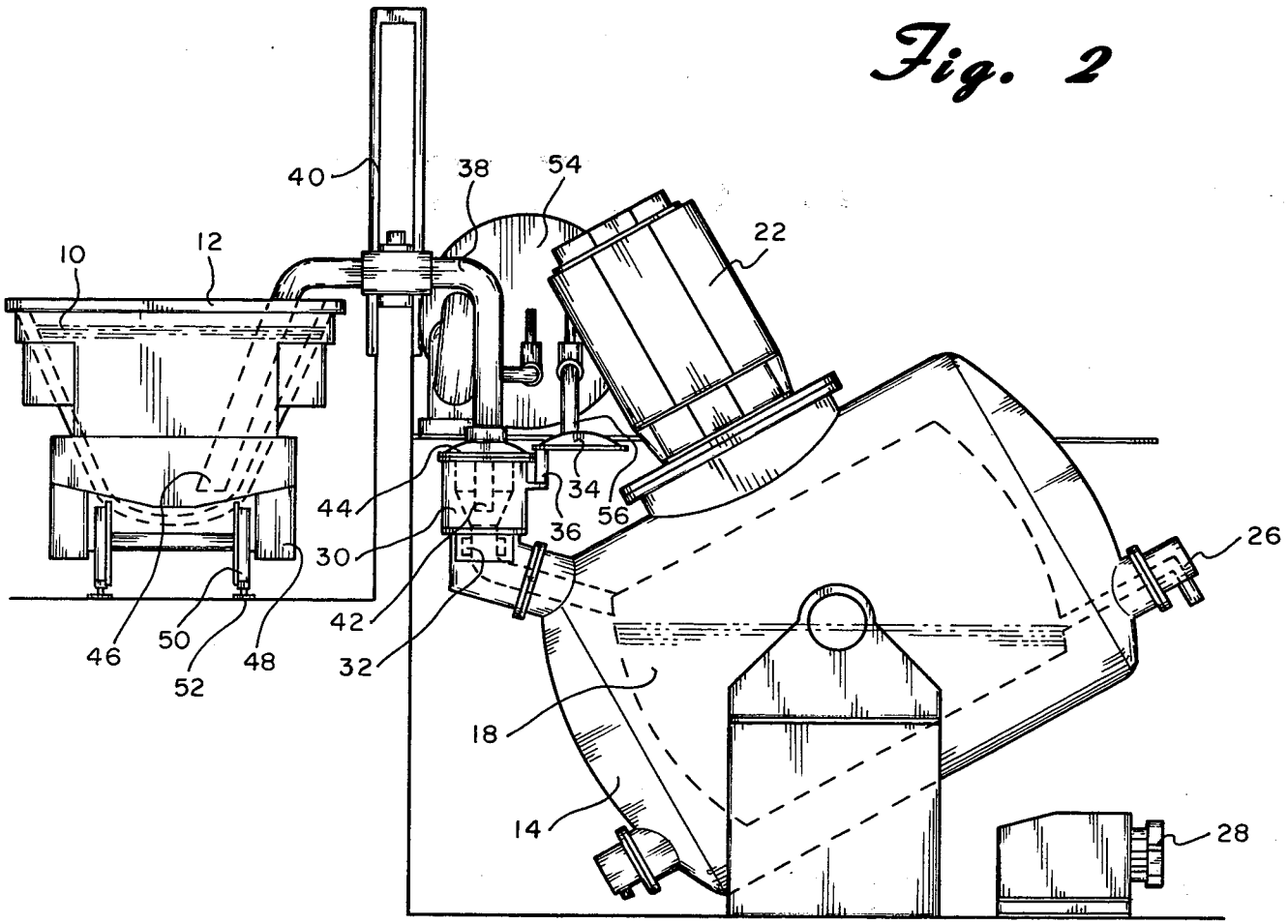
FIG. 2 is an elevational view similar to FIG. 1 but showing the various components in proper condition for filling the furnace with molten slag.

With the feed tube 38 in the position shown in FIG. 2, the tube can be utilized as a siphon to draw the molten feed slag 10 from the receptacle 12 into the interior of the furnace 14. The siphon will function as long as the discharge end 42 is below the inlet end 46 and the level of the molten slag 10 is above the opening in the inlet end of the siphon or feed tube 38. It is, of course, necessary to prime a siphon or initiate flow therethrough before a siphon will function and this is accomplished in the present invention in the following manner.

Located adjacent the furnace 14 is a relatively large auxiliary vessel or tank 54. A first valved conduit 56 from the tank 54 is adapted to be connected to the interior of the furnace 14 by way of valved port 58. Conduit 56 is not permanently connected to the port 58 but may be readily connected thereto and disconnected therefrom for the reasons which will become more apparent hereinafter. A second conduit 60 from tank 54 is connected to a vacuum pump 62 which is used to evacuate the tank 54.

When it is desired to feed the molten slag 10 into the interior of the furnace, tank 54 is first evaluated so as to create a vacuum therein through the use of vacuum pump 62. Furnace 14 is then tilted into the position shown in FIG. 2 and the siphon or feed tube 38 is lowered into the position there shown with cover 44 sealing the top of the inlet port 30 and the inlet end 46 of the siphon submerged in the slag 10. At this time, valve 32 is opened and conduit 56 is connected to the port 58 but the furnace otherwise remains totally sealed. The valve in conduit 56 is then opened and the 1500 degree atmospheric pressure gases from the furnace 14 flow through conduit 56 into the tank 54 thereby lowering the pressure within the furnace 14 and the feed tube 38 to initiate the flow of molten slag 10 from the receptacle 12 through the siphon or feed tube 38 into the interior of the furnace 14.

Once the molten slag begins to flow, it will continue to do so as a result of the siphoning effect. Prior to the time that the inlet end 46 of the feed tube 38 is uncovered, flow is terminated by increasing the pressure within the furnace 14 through the use of other gas lines not shown. This permits the furnace to now be totally resealed without the ingress of any atmospheric air throughout the entire charging cycle.

The present invention may be embodied in other specific forms without departing from the spirit or essential attributes thereof and accordingly, reference should be made to the appended claims rather than to the foregoing specification as indicating the scope of the invention.

I claim:

1. In an electric melting furnace for the production of mineral wool from slag including a carbon-lined fully enclosed crucible, means for controlling the atmosphere within said crucible, electric means for heating the slag within said crucible, a taphole for removing molten slag from said crucible and means for feeding slag into said crucible for heating the same without allowing atmospheric gases to enter said crucible; the improvement in said feeding means including means for feeding molten slag into said crucible and including an inlet feed port and a refractory lined feed tube having one end adapted to be placed in sealing engagement with said inlet feed port and means for reducing the atmospheric pressure within said feed tube to at least initiate the flow of molten slag from an external receptacle into said tube and then into said crucible.

2. The improvement as claimed in claim 1 wherein the other end of said tube is inserted into said external receptacle and wherein said receptacle, said tube and said crucible are arranged so that said tube functions as a siphon to draw molten slag from said receptacle into said crucible.

3. The improvement as claimed in claim 2 wherein said means for reducing the atmospheric pressure within said feed tube includes an auxiliary vessel connected to said crucible through a valved conduit and means for evacuating said vessel.

4. In a process for the production of mineral wool from slag including the steps of feeding slag to the interior of a carbon-lined crucible and electrically heating said slag while controlling the atmosphere within said crucible, the improvement wherein molten slag is fed through a feed tube into said crucible to be heated therein without allowing external atmospheric air to enter thereby continuously controlling the atmosphere within said crucible and wherein said molten slag is at least initially drawn into said feed tube from an external receptacle by negative pressure.

5. The improvement as claimed in claim 4 wherein said molten slag is siphoned into said crucible from said external receptacle.

* * * * *